US007334506B2

(12) United States Patent
Hui

(10) Patent No.: US 7,334,506 B2
(45) Date of Patent: Feb. 26, 2008

(54) ANTI-WEARING SOCKET AND INNER LINING THEREOF

(76) Inventor: David Hui, 10-1 Fl., No. 223, Nanking East Road, Sec. 5, Taipei (TW)

( * ) Notice: Subject to any disclaimer, the term of this patent is extended or adjusted under 35 U.S.C. 154(b) by 400 days.

(21) Appl. No.: 11/003,713

(22) Filed: Dec. 6, 2004

(65) Prior Publication Data

US 2006/0117915 A1 Jun. 8, 2006

(51) Int. Cl.
*B25B 13/06* (2006.01)
*B25B 13/58* (2006.01)

(52) U.S. Cl. ..... 81/124.4; 81/125.1; 81/185; 81/DIG. 11

(58) Field of Classification Search ..... 81/124.4, 81/124.6, 125.1, 180.1, 185, 185.1, DIG. 11
See application file for complete search history.

(56) References Cited

U.S. PATENT DOCUMENTS 1,360,121 A * 11/1920 Lawrence ..... 81/124.4
3,233,482 A * 2/1966 Jehne ..... 81/185
3,433,108 A * 3/1969 Ondeck ..... 81/124.6
4,620,460 A * 11/1986 Gonzales, Jr. ..... 81/124.4
4,836,067 A * 6/1989 Rogers et al. ..... 81/185
4,840,094 A * 6/1989 Macor ..... 81/185
4,979,355 A * 12/1990 Ulevich ..... 81/185
5,048,379 A * 9/1991 Gramera et al. ..... 81/124.4

* cited by examiner

*Primary Examiner*—Debra S Meislin

(57) ABSTRACT

A socket includes an inner lining detachably formed in an inner hole within the socket, with the inner lining formed therein with a differentially-sized torque recess including at least a large hexagonal hole defining a large diagonal distance ($D_1$) between two diagonal points of the large hexagonal hole and a small hexagonal hole gradationally contracted inwardly from the large hexagonal hole and defining a small diagonal distance ($D_2$) between two diagonal points of the small hexagonal hole, so that each inner lining may be provided for selectively engaging at least two differently-sized nuts (or bolts) for convenient and economic torquing purpose.

2 Claims, 3 Drawing Sheets

ANTI-WEARING SOCKET AND INNER LINING THEREOF

BACKGROUND OF THE INVENTION

U.S. Pat. No. 6,397,706 to Peter J. Maznicki disclosed a protective socket adapted to torque a head of a hardware fastener, having a non-marring inner lining disposed within an outer sleeve of the socket for protecting the hardware from being marred.

However, such a prior art disclosed the inner lining (14) of unique size of only one torquing hole (20) provided within the lining (14) so that a plurality of linings should be prepared ready for insertion into differently-sized torquing holes of differently-sized hardware fasteners, thereby causing maintenance inconvenience and possibly increasing the implementation cost for mechanical jobs or maintenance work.

The present inventor has found the drawbacks of the prior art and invented the present socket having differentially-sized torque hole formed in an inner lining in the socket adapted for a convenient, economic and efficient selective engagement of proper nut or bolt with the lining for enhancing anti-wearing effect for the nut or bolt and the socket.

SUMMARY OF THE INVENTION

The object of the present invention is to provide a socket including an inner lining detachably formed in an inner hole within the socket, with the inner lining formed therein with a differentially-sized torque recess including at least a large hexagonal hole defining a large diagonal distance ($D_1$) between two diagonal points of the large hexagonal hole and a small hexagonal hole gradationally contracted inwardly from the large hexagonal hole and defining a small diagonal distance ($D_2$) between two diagonal points of the small hexagonal hole, so that each inner lining may be provided for selectively engaging at least two differently-sized nuts (or bolts) for convenient and economic torquing purpose.

DETAILED DESCRIPTION

Figure 1:
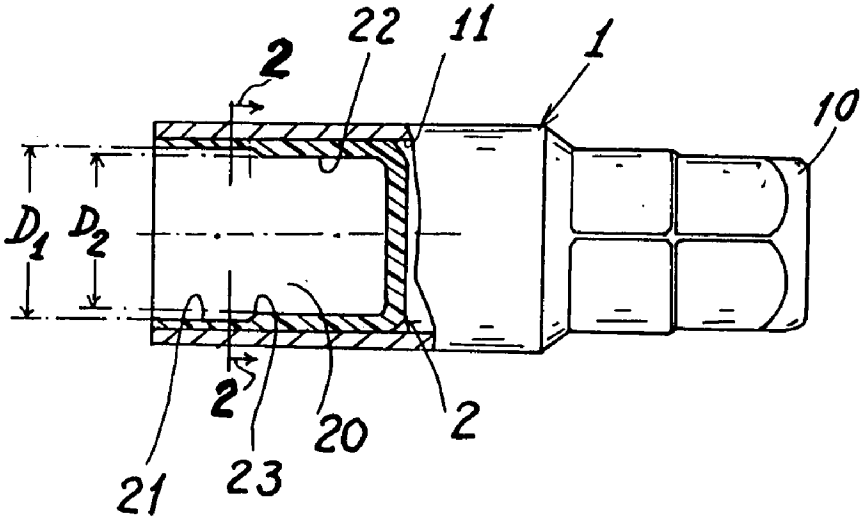
FIG. 1 is a sectional drawing of the present invention.
Figure 2:
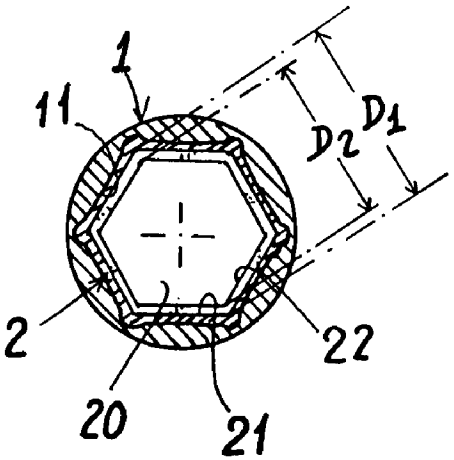
FIG. 2 is a cross sectional drawing of the present invention as viewed from 2—2 line of FIG. 1.

As shown in FIGS. 1 and 2, an anti-wearing socket 1 of the present invention comprises: an inner lining 2 formed or detachably formed in an inner hole 11 recessed in the socket 1, having a driving head portion 10 formed on a top portion of the socket 1 opposite to the inner hole 11 and adapted for engaging a tool including a wrench for driving the socket and accordingly driving a nut or bolt (not shown) inserted or engaged in a torque recess 20 recessed in the inner lining 2.

The torque recess 20 recessed in the inner lining 2 includes a large hexagonal hole 21 defining a large diagonal distance $D_1$ between two diagonal points of the large hexagonal hole 21, and a small hexagonal hole 22 gradationally contracted inwardly from the large hexagonal hole 21 and defining a small diagonal distance $D_2$ between two diagonal points of the small hexagonal hole 22, with the small diagonal distance $D_2$ being smaller (or shorter) than the large diagonal distance $D_1$, so that each inner lining 2 as formed in the socket 1 may be selectively engaged with a large nut (or bolt) or engaged with a small nut (or bolt) in the respective corresponding hexagonal hole 21 or 22.

Accordingly, one lining 2 in the socket 1 may be provided for respectively engaging two nuts (or bolts) different in size. By the way, the cost for factory implementation can be reduced and the torquing or maintenance job may be done more conveniently, economically and efficiently.

The torque recess 20 in the inner lining 2 may further include a tapered portion 23 formed in between the large hexagonal hole 21 and the small hexagonal hole 22, with the tapered portion 23 concentrically tapered inwardly from the large hexagonal hole 21 towards the small hexagonal hole 22 for a smooth and quick insertion of a small nut (or bolt) from the large hexagonal hole 21 into the small hexagonal hole 22.

The inner lining 2 may be detachably formed, inserted, embedded or secured in the inner hole 11 as recessed in the socket 1.

The inner lining 2 may also be fixedly secured, coated, deposited, or formed in situ on an inner surface of the inner hole 11 within the socket 1, not limited in the present invention.

The inner lining 2 may be made of plastic, rubber, composite or elastomer materials, but not limited in the present invention.

Figure 3:
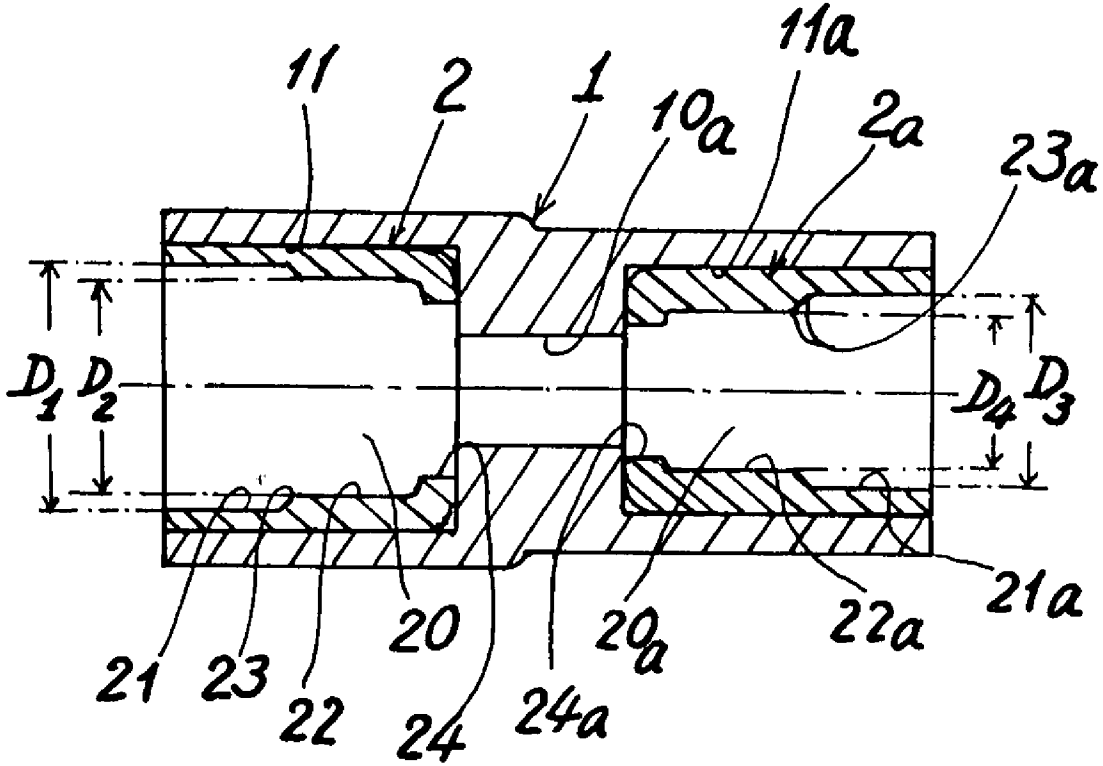
FIG. 3 is a sectional drawing of another preferred embodiment of the present invention.

As shown in FIG. 3, another preferred embodiment of the present invention is illustrated, which comprises a socket 1 having two inner holes 11, 11*a* having different size recessed in opposite end portions of the socket 1, having an intermediate driving polygonal (e.g., square) hole 10*a* formed in a middle section in the socket 1 between the two inner holes 11, 11*a;* a first inner lining 2 formed or detachably formed in a first inner hole 11 recessed in a left side portion of the socket 1, a first torque recess 20 recessed in the first inner lining 2 including a first-sized hexagonal hole 21 defining a first-sized diagonal distance $D_1$ between two diagonal points of the first-sized hexagonal hole 21, and a second-sized hexagonal hole 22 gradationally contracted inwardly from the first-sized hexagonal hole 21 and defining a second-sized diagonal distance $D_2$ between two diagonal points of the second-sized hexagonal hole 22, with the second-sized diagonal distance $D_2$ being smaller than the first-sized diagonal distance $D_1$, so that the first inner lining 2 as formed in a left side of the socket 1 may be selectively engaged with two nuts (or bolts) of two size, i.e., as first-sized and second-sized; and a second inner lining 2*a* formed or detachably formed in a second inner hole 11*a* recessed in a right side portion of the socket 1, a second torque recess 20*a,* smaller than the first torque recess 20, recessed in the second inner lining 2*a* including a third-sized hexagonal hole 21*a* smaller than the second-sized hexagonal hole 22 and defining a third-sized diagonal distance $D_3$ between two diagonal points of the third-sized hexagonal hole 21*a,* and a fourth-sized hexagonal hole 22*a* gradationally contracted inwardly from the third-sized hexagonal hole 21*a* and defining a fourth-sized diagonal distance $D_4$ between two diagonal points of the fourth-sized hexagonal hole 22*a,* with the fourth-sized diagonal distance $D_4$ being smaller than the third-sized diagonal distance $D_3$, so that the second inner lining 2*a* as formed in the right side of the socket 1 may be selectively engaged with further two nuts (or bolts) as third-sized and fourth-sized.

Therefore; the two inner linings 2, 2*a* as provided in the socket 1 as shown in FIG. 3 may be engaged with four differently-sized nuts (or bolts) having their size gradually reduced. The size sequence of the diagonal distance is: $D_1>D_2>D_3>D_4$.

Naturally, each inner lining 2 or 2*a* may be formed with a torque recess having a plurality of differently-sized diagonal holes gradationally formed in each torque recess, not limited to be two diagonal holes 21, 22 (or 21*a*, 22*a*) as shown in the accompanying drawings in this invention.

The present invention may be modified without departing from the spirit and scope of the present invention.

Figure 4:
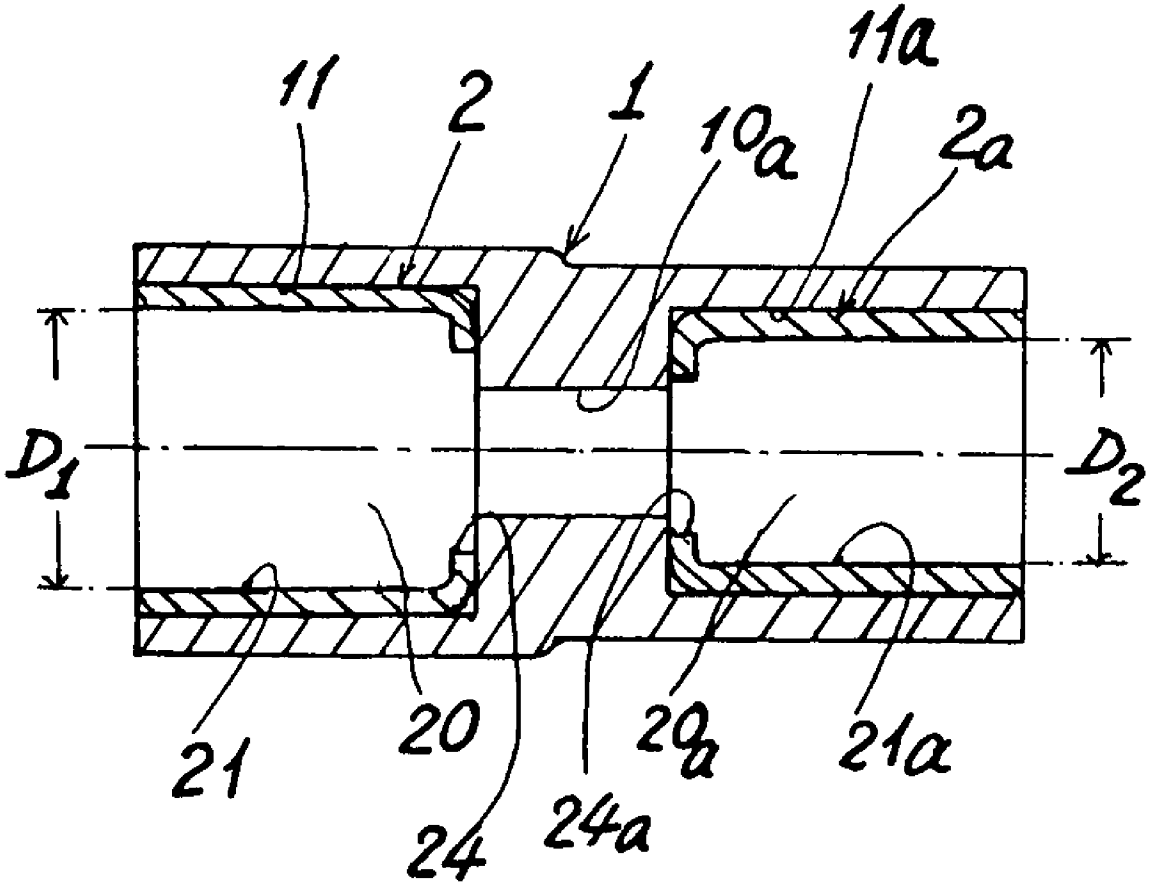
FIG. 4 is a sectional drawing of further preferred embodimnet of the present invention.

For instance, a further preferred embodiment as shown in FIG. 4 is given, in which the first inner lining 2 as formed in the first (left) inner hole 11 is modified to include a first-sized hexagonal hole 21 defining a first-sized diagonal distance $D_1$, and the second inner lining 2*a* as formed in the second (right) inner hole 11*a* is modified to include a second-sized hexagonal hole 21*a* defining a second-sized diagonal distance $D_2$, so that either the left side lining 2 or the right side lining 2*a* may be selectively engaged with a large nut (or bolt) or a small nut (or bolt).

As shown in FIGS. 3, 4, each lining 2 or 2*a* should be formed with a through hole 24, 24*a* through an inner end cover of each lining for driving the socket.

The present invention may be used for engaging a nut or bolt of polygonal shapes.

I claim:

1. A socket having two inner holes with different size recessed in opposite end portions of the socket, having an intermediate driving polygonal hole formed in a middle section in the socket between the two inner holes; said socket comprising a first inner lining formed in a first inner hole recessed in a left side portion of the socket, having a first torque recess recessed in the first inner lining, and including a first-sized hexagonal hole defining a first-sized diagonal distance ($D_1$) between two diagonal points of the first-sized hexagonal hole, and a second-sized hexagonal hole gradationally contracted inwardly from the first-sized hexagonal hole and defining a second-sized diagonal distance ($D_2$) between two diagonal points of the second-sized hexagonal hole, with the second-sized diagonal distance ($D_2$) being smaller than the first-sized diagonal distance ($D_1$), so that the first inner lining as formed in a left side of the socket is selectively engaged with two nuts or bolts as first-sized and second-sized; and a second inner lining formed in a second inner hole recessed in a right side portion of the socket, having a second torque recess, smaller than the first torque recess, recessed in the second inner lining, and including a third-sized hexagonal hole smaller than the second-sized hexagonal hole and defining a third-sized diagonal distance ($D_3$) between two diagonal points of the third-sized hexagonal hole, and a fourth-sized hexagonal hole gradationally contracted inwardly from the third-sized hexagonal hole and defining a fourth-sized diagonal distance ($D_4$) between two diagonal points of the fourth-sized hexagonal hole, with the fourth-sized diagonal distance ($D_4$) being smaller than the third-sized diagonal distance ($D_3$), so that the second inner lining as formed in the right side of the socket is selectively engaged with further two nuts or bolts as third-sized and fourth-sized.

2. A socket according to claim 1, where said inner lining is detachably secured in said inner hole formed in said socket.

* * * * *